United States Patent [19]

Forrest

[11] Patent Number: 4,991,238

[45] Date of Patent: Feb. 12, 1991

[54] SPA COVER LIFT

[76] Inventor: Stephen Forrest, 6272 Guava Ave., Goleta, Calif. 93117

[21] Appl. No.: 185,500

[22] Filed: Feb. 27, 1990

[51] Int. Cl.[5] ..... E04H 4/00; A47K 3/02

[52] U.S. Cl. ..... 4/498; 4/580

[58] Field of Search ..... 4/494, 498, 500, 503, 4/546, 548, 557, 580; 220/323, 333, 335, 85 CH; 248/240.4, 242.1, 291; 224/42.03, 42.08, 42.44; 49/463

[56] References Cited

U.S. PATENT DOCUMENTS

| | | | |
|---|---|---|---|
| 4,234,973 | 11/1980 | Vetter et al. | 4/500 |
| 4,351,505 | 9/1982 | Wickersham | 248/316 |
| 4,853,985 | 8/1989 | Perry | 4/498 |
| 4,857,374 | 8/1989 | Perry | 428/71 |

OTHER PUBLICATIONS

"Rover* Thermal Cover", product description (No date).

"Coverslide", product description (No date).

*Primary Examiner*—Henry J. Recla
*Assistant Examiner*—Antoine A. Gamarra
*Attorney, Agent, or Firm*—Venable, Baetjer, Howard & Civiletti

[57] ABSTRACT

A spa cover lift is provided that includes a movable frame adapted for pivotable attachment to the side of a spa, one or more struts for positioning the movable frame between extended and retracted positions with respect to the side of the spa, and apparatus for receiving a spa cover from the spa and retaining the cover adjacent the movable frame. The struts are operable to displace the movable frame to an extended position that is substantially coplanar with respect to the top surface of the spa to provide a surface onto which a spa user can slide a spa cover. The struts are further operable to displace the movable frame to a retracted position against the side of the spa for optimally storing the device along with the spa cover in a compact configuration when the spa is in use against the side of the spa.

32 Claims, 5 Drawing Sheets

FIG. 1
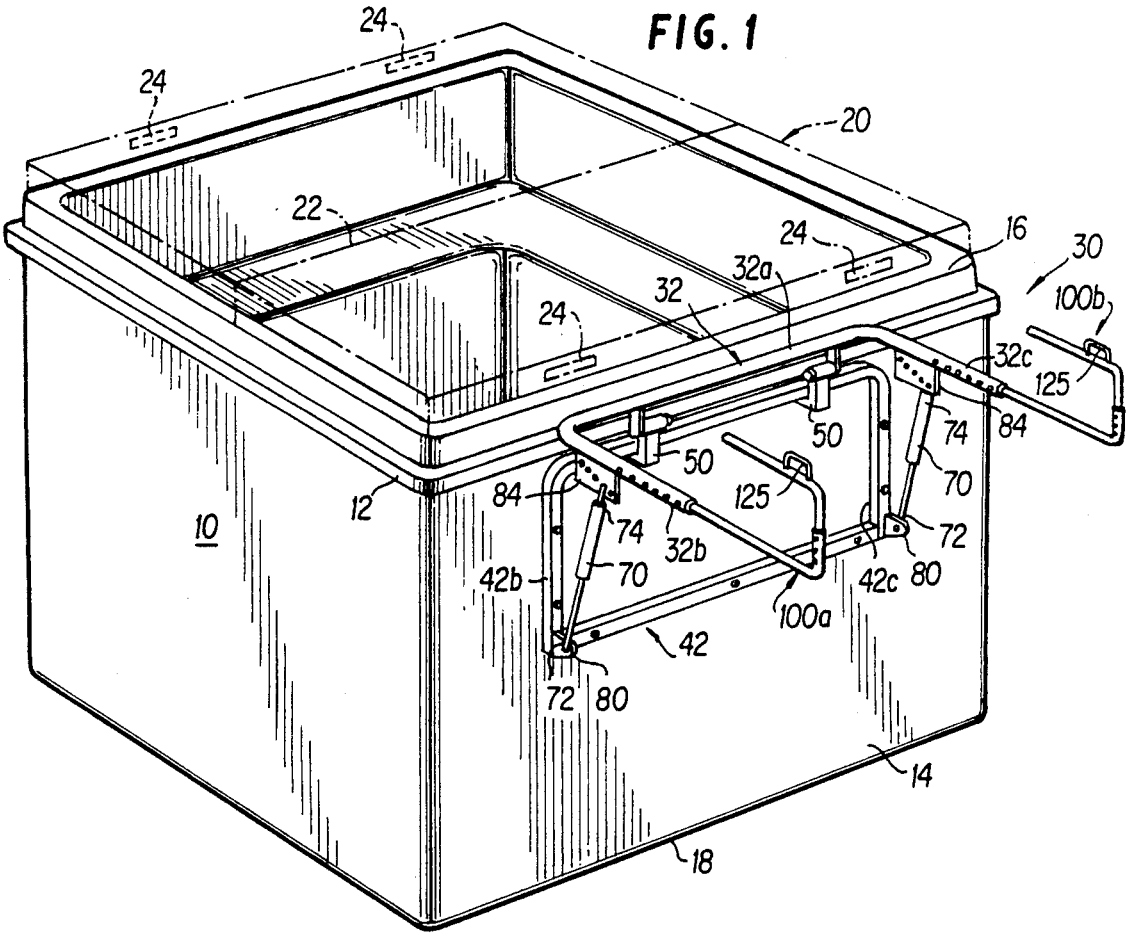
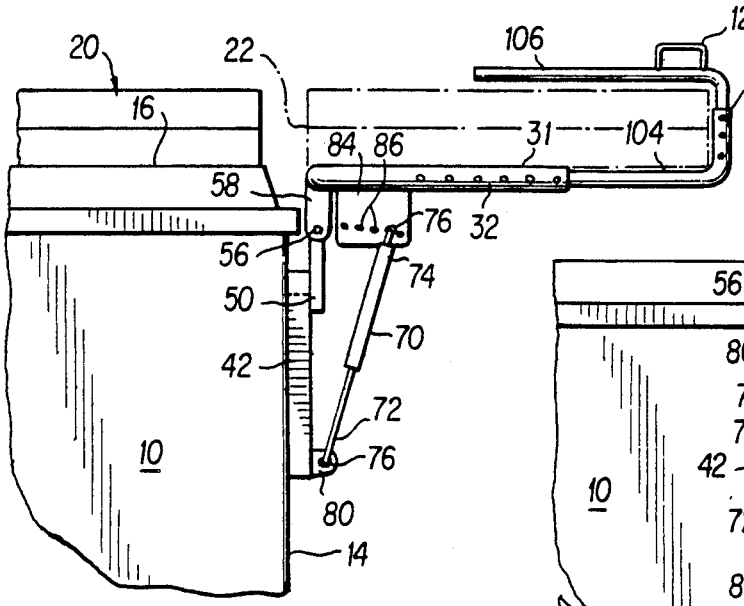
FIG. 2
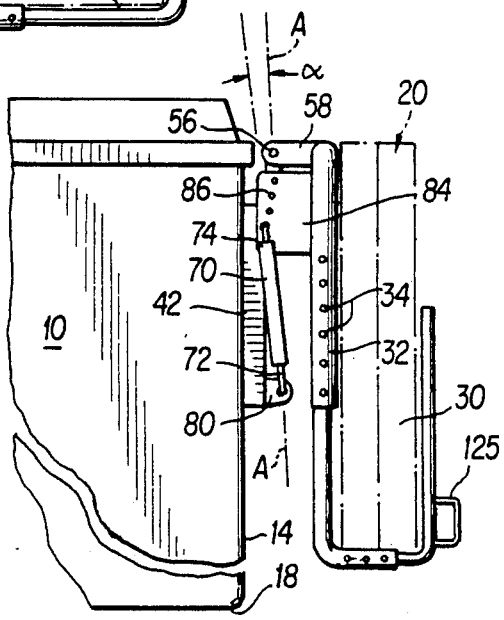
FIG. 3A

SPA COVER LIFT

BACKGROUND OF THE INVENTION

1. Field of the Invention

The present invention relates generally to apparatus for handling the cover of a spa, and more particularly to apparatus attachable to the side of the spa for receiving and retaining the spa cover when the spa is to be used.

2. Background of the Related Art

While spas vary in size, a spa is typically comprised of an upright, watertight structure which has means to generate and contain hot, turbulent water and is of sufficient size to accommodate approximately four to six persons seated therein. Spa users may partially submerge themselves in the hot turbulent water contained within the spa for a brief period of time, depending on the temperature of the water, for pleasure and for therapeutic reasons. Spas have generally become increasingly popular, as spa users find the spa water soothing. Further, spas are beneficial, particularly to handicapped and elderly persons, in that the hot turbulent water relaxes the bodily muscles and joints of spa users to encourage greater fluidity of their body movement.

A spa is generally provided with insulative material on the sides thereof and with an insulative removable cover over the top surface thereof to retain the heat that is generated within the spa, thereby maintaining the water temperature at a desired level. When the cover is positioned across the top surface of the spa, the cover is particularly useful in preventing debris from entering the spa and in reducing the rate of evaporation of chemicals used to treat the spa water. The cover also serves an important safety role by inhibiting the entry of small children and animals into the spa.

A spa cover generally comprises a piece of dense foam material having a thickness of approximately 2–3 inches that is dimensioned to cover the top surface of the spa. The foam material is preferably covered by a substantially water-resistent material such as vinyl, and is generally partitioned into two or more sections that are separated by a crease or fold line to permit folding of the cover along the crease or fold line to facilitate handling and storage when the spa is to be used.

Despite the fact that most spa covers can be folded into a more compact configuration for handling by the spa user, spa covers are generally large, heavy, and bulky. For most spa owners, the substantial weight and awkward size of the cover renders the task of its removal from and placement on the spa to be so burdensome that the spa is used less frequently than desired. Many spa users must generally be assisted by another person in handling the cumbersome spa cover, rendering the use of the spa to be inconvenient. Further, the cover is difficult to maneuver into an upright position for storage so as to allow condensation and rainwater to drain from the surfaces of the cover. The collection of water on the surfaces of the cover increases the weight of the cover, as well as encourages the uptake of debris and the growth of mildew, particularly when the cover is placed on the ground or flooring at the base of the spa. Thus, when the cover is returned to the top surface of the spa, dirt and debris can be transferred from the cover into the water contained within the spa. In addition to being soiled, the vinyl material that typically envelops the foam of the spa cover is subjected to tearing, as users oftentimes drag the spa cover over abrasive surfaces such as corners of the spa structure and the ground or flooring at the base of the spa during the removal from and the placement of the spa cover onto the top surface of the spa. Further, stitching in the vinyl material, and particularly that which is required to attach handles to the spa cover, is subjected to wear as the result of lifting the cover to and from the spa.

Several prior types of spa covers and spa cover accessories have been proposed in an attempt to overcome some of the aforementioned problems associated with spa covers. For example, one variety of spa cover comprises a generally rigid cover member that is configured to be a substantially integral part of the spa structure. The cover member of this particular type of spa cover is generally supported along one side of the spa structure by rigid arms that are pivotable so as to position the cover from a reclined position on the top surface of the spa to an upright position extending from the side of the spa when the spa is in use. This known cover is disadvantageous for, among other reasons, the spa cover obstructs the view of spa users seated within the spa when the cover is in the upright position and is susceptible to wind. Further, a spa cover of this type is generally costly, as the cover must be formed from a material that is generally more rigid than the foam material used with conventional covers in order to allow for the upright positioning of the cover. Further, the cover and the arms must be configured for a specific spa size. For all of the foregoing reasons, this type of cover is not readily adaptable for use with other than that type of spa for which it is specifically constructed.

One known variety of cover accessory for spas is designed to be attachable to the side of a spa and is configured to provide a surface on which the cover may be supported when the spa is in use. The supportive surface extends from the side of the spa and is substantially horizontal with respect to the ground. Thus, water is not permitted to drain from the surfaces of the cover when the cover is removed from the top surface of the spa. Further, the device does not provide for the compact storage of the cover when the spa is in use, as the supportive surface extends a distance from a side of the spa that is generally the same as the dimensional width of the cover when the cover is folded, thereby requiring that a cumbersome amount of unoccupied space be available for accommodation of the spa and its cover accessory.

Although the aforementioned prior types of spa covers and spa cover accessories overcome some of the above-noted problems associated with the use of spas, there remains a need for apparatus that assist spa users in the handling of a cumbersome spa cover, that is detachable and adjustable so as to facilitate the use of the apparatus with many types of spas, that is configured for compact storage when not in use, and that stores the cover in a compact configuration in a manner which prevents the cover from being soiled and subjected to wear and tear otherwise associated with the handling of the cover, and which permits water to drain from the surfaces of the cover when the cover is not in use.

SUMMARY OF THE INVENTION

The present invention provides a spa cover support device which overcomes the inherent limitations of previously proposed spa covers and cover accessories for spas, particularly those spa covers that are substantially integral parts of the spa structure and those cover accessories that merely provide a supportive surface on which the cover can rest when the spa is in use.

In accordance with the invention, the spa cover support device comprises a movable frame that is pivotably attachable to the spa such that the movable frame can be displaced between extended and retracted positions with respect to the side of the spa. The movable frame can be positioned in an extended position to provide a supportive surface that is substantially coplanar with respect to the top surface of the spa. The cover of the spa may therefore be slid from the top surface of the spa onto the supportive surface, thereby obviating the need for the spa user to lift the spa cover substantial distances above the spa, a process that can be oftentimes cumbersome. The movable frame can be positioned in a retracted position that is adjacent to the side of the spa for compact storage of the spa cover support device when the cover is disposed on the top surface of the spa.

The movable frame is provided with means for retaining the cover against a supportive surface throughout the displacement of the movable frame between extended and retracted positions. Further, the retaining means permit for the cover to be stored in a generally vertical position against the side of the spa. Vertical storage of the spa cover affords numerous advantages over the prior art, such as preventing the cover from collecting debris from the surfaces surrounding the spa, and permitting for the drainage of water from the surfaces of the cover. The vertical storage of the cover against the side of the spa is also advantageous in that the cover is not susceptible to wind and does not obstruct the view of spa users who are seated in the spa.

The spa cover support device of the present invention is constructed in a manner which minimizes the effort which must be exerted by the spa user in handling the spa cover. One or more struts can be provided for displacing the movable frame between extended and retracted positions. The struts can be arranged in an overcenter configuration to create a retentive force which maintains the movable frame against the side of the spa when the movable frame is in a retracted position. The retentive force can be overcome upon the exertion of a nominal force against the movable frame, whereby the struts are operable to displace the movable frame to an extended position. Once the cover device has been advanced to the extended position, the cover can be readily advanced onto or removed from the cover device in accordance with a user's intentions.

BRIEF DESCRIPTION OF THE DRAWINGS

The various aspects, advantages, and novel features of the present invention will be more clearly understood from the following detailed description when read in conjunction with the appended drawings, in which:

FIG. 1 is a perspective view of a spa cover support device constructed in accordance with the present invention, shown mounted to the side of a spa.

FIG. 2 is a side elevational view of the spa cover support device of FIG. 1, shown in an extended position.

FIG. 3*a* is a side elevational view of the spa cover support device of FIG. 1, shown in a retracted position.

DETAILED DESCRIPTION OF THE PREFERRED EMBODIMENTS

Figure 3B:
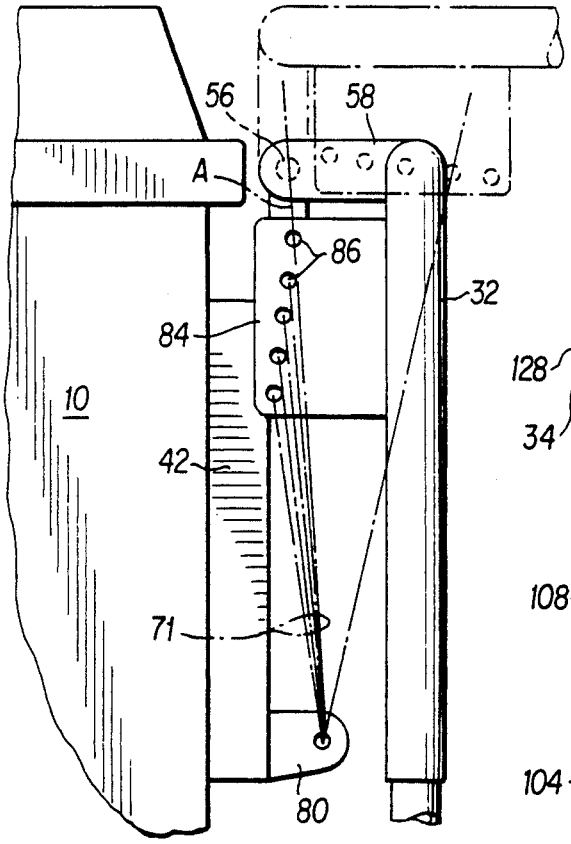
FIG. 3*b* is a partial and enlarged view of the spa cover support depicted in FIG. 3*a*.

With reference to the drawings, wherein corresponding parts are designated by corresponding reference characters throughout the various views, and with particular reference to FIG. 1, there is depicted a spa cover support device, designated generally by reference numeral 30, constructed in accordance with the present invention. In the illustrated embodiment, the spa cover support device 30 is shown mounted along a vertical side wall 14 of a spa 10. The spa 10 is provided with an overlying cover 20, which is indicated by phantom lines in FIG. 1, that is of sufficient size to cover the open-faced upper surface 16 of the spa 10 so as to prevent debris from entering the water contained within the spa 10, as well as to reduce the evaporation of water and chemicals that are used to treat the water. The spa cover can optionally be insulated with a foam or similar insulator material to retain the heat generated by the spa and to maintain water temperature at a desired level. The cover as shown is formed in two sections that are joined along a crease or fold line 22 to permit the spa cover 20 to be folded in half along the crease, as shown in FIG. 2. However, it is to be appreciated that the spa cover support device of the subject invention is applicable for use with spa covers having a different number of sections. The spa cover 20 is typically provided with handles 24 that are affixed to opposing sides of the spa cover, as shown in FIG. 1, to provide the spa user with means for facilitating handling of the spa cover 20.

In accordance with the illustrated embodiment of the invention, the spa cover 20 can be positioned within a portion of the spa cover support device 30, as indicated by the phantom lines in FIG. 2, to permit usage of the spa. The spa cover support device 30 is extensible between an extended position that is generally perpendicular to the side wall 14 of the spa 10 (FIG. 2) and a retracted position that is generally parallel to the spa side wall (FIG. 3*a*). The extended spa cover support device 30 provides a receiving surface 31 for the spa cover 20 which is generally coplanar with the open-faced upper surface 16 of the spa 10. Thus, the spa user can remove the spa cover 20 from the upper surface 16 of the spa 10 by merely sliding the cover 20 onto the generally coplanar receiving surface 31 of the extended spa cover support device 30, thereby avoiding altogether the difficulty associated with lifting and carrying of the cover.

The spa cover support device 30 can be displaced toward the retracted position adjacent the side wall 14 of the spa 10, as shown in FIG. 3*a*, to store the spa cover 20 in a compact configuration above the surface of the ground following its removal from the spa. Vertical storage of the spa cover 20 in the manner depicted in FIG. 3*a* is advantageous, for it permits drainage of water from the surfaces of the spa cover 20 and minimizes cover uptake of debris from surrounding surfaces. Further, the cover is stored against the side of the spa when not in use so as not to obstruct the view of spa users seated in the spa, for reduced susceptability to winds and for improved aesthetics over previously proposed spa covers and accessories for spas. The extensible and retractable spa cover support device 30 also serves to prolong the life of the cover 20 by minimizing cover handling by the user and inadvertent mishandling by obviating altogether the need for the spa user to manually drag the cover across abrasive and/or dirty surfaces such as the edges of the spa structure and the flooring or ground at the base 18 of the spa 10, thereby subjecting the vinyl material which envelops the foam of the spa cover 20 to fewer tears. Further, the spa cover support device 30 reduces wear on the stitching in the vinyl material, for example, in the stitching which attaches the handles 24 to the spa cover 20, by eliminating the need for the spa user to lift and carry the spa cover 20 by the handles 24.

Figure 4:
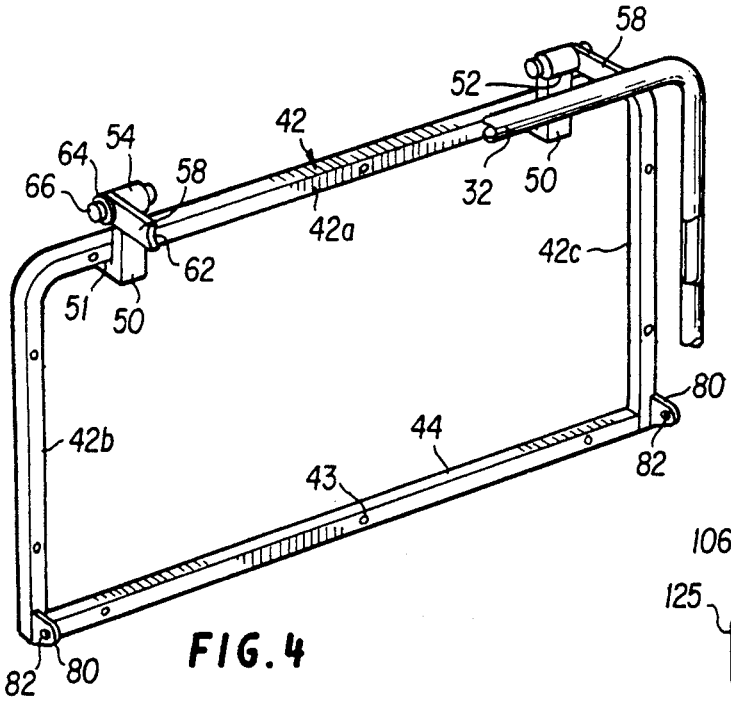
FIG. 4 is an isolated perspective view of the mounting frame member of the spa cover support of FIG. 1 that is attached to the spa.

The manner by which the spa cover support device 30 is extensible and retractable into the positions illustrated in FIGS. 2 and 3*a* will now be described. In the illustrated embodiment, the spa cover support device 30 includes a movable frame 32 which is pivotable with respect to a fixed frame 42. The movable frame 32 comprises a unitary tubular member that is formed into a generally U-shaped frame, as shown in FIG. 1. With reference to FIG. 4, the fixed frame 42 can be similarly constructed from a unitary tubular member which comprises a generally U-shaped frame having an intermediate portion 42*a* from which two legs 42*b* and 42*c* depend. The fixed frame 42 is secured to the side wall 14 of the spa 10 in a conventional manner, as by attachment with a plurality of screws 43, such that the intermediate portion 42*a* thereof is disposed generally parallel with respect to the lip 12 (FIG. 1) of the spa 10 and the legs 42*b* and 42*c* extend downwardly toward the spa base 18. The fixed frame 42 preferably further includes a cross-member 44 disposed between the legs 42*b* and 42*c* of the fixed frame 42 to structurally reinforce the fixed frame to further enable it to support the weight of the movable frame 32 and associated hardware along with the weight of the spa cover 20 when the spa cover support device 30 of the present invention is in use.

With further reference to FIG. 4, the fixed frame 42 is provided with two, generally L-shaped pivot support members 50 for pivotably mounting the movable frame 32 to the fixed frame 42. Each of the pivot support members 50 is affixed at one end thereof to the intermediate portion 42*a* of the fixed frame 42 by coupling a leg portion 51 of each of the pivot support members 50 to a surface such as the underside 41 of the intermediate portion 42*a* of the fixed frame 42. In the illustrated embodiment, each of the pivot support members 50 extends outwardly from the underside 41 of the intermediate portion 42*a* of the fixed frame 42 and upwardly with respect to the spa 10 so as to provide clearance between the free end 52 of each of the pivot support members 50 and the lip 12 of the spa 10.

Figure 6:
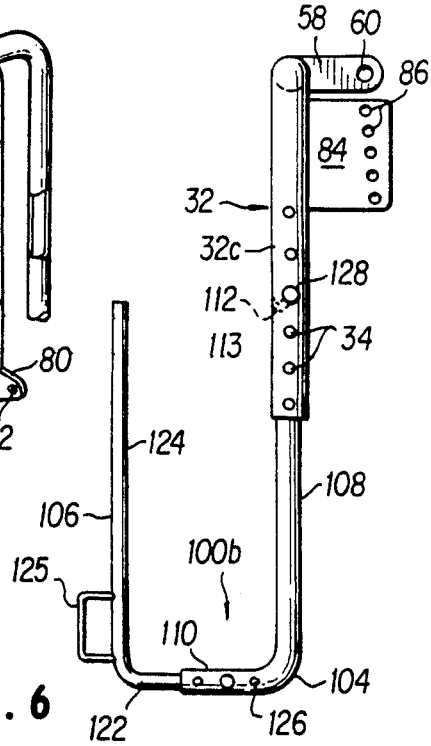
FIG. 6 is a side elevational view of the movable frame member depicted in FIG. 5.

With reference to FIGS. 4 and 6, each of the pivot support members 50 further comprises an cylindrical sleeve 54 which includes a longitudinal bore that defines an internal bearing surface for a shoulder bolt 56 that is insertable therethrough. The cylindrical sleeve of each support 50 is coupled in a conventional manner to the free end 52 of each of the pivot support members 50. The movable frame 32 is pivotably secured to each of the pivot support members 50 by a tab 58 that extends generally transversely from the intermediate portion 32*a* of the frame 32. The tab 58 is preferably formed as a substantially flat arm that comprises an aperture 60 at one end thereof, as shown in FIG. 6, which is dimensioned to receive therethrough a shoulder bolt 56 for coupling with a corresponding support member 50. The end of the tab 58 opposite that of aperture 60 is configured with an appropriately curved edge surface 62 to permit for coupling of the tab 58 to the exterior of the tubular movable frame 32. A shoulder bolt 56 is inserted through the bore of each of the cylindrical members 54 such that one end of the bolt 56 extends beyond the corresponding cylindrical member 54 and is threaded into a corresponding tab 58. Each tab 58 is maintained in abutment against one end of a corresponding cylindrical member 54 by one or more bushings 64 and a threaded nut 66 which is fastened to a similarly threaded end of a corresponding shoulder bolt 56 extending beyond the tab 58. The tab 58 is, therefore, rotatable about the axis of the shoulder bolt 56 within the bushings 64 when the movable frame 32 pivots with respect to the fixed frame 42 between the extended and retracted positions shown in FIGS. 2 and 3*a*, respectively. In FIG. 2, the tab 58 is vertically displaced with respect to the side 14 of the spa 10 when the movable frame 32 is extended, and is generally perpendicular to the side 14 of the spa 10 and extends outwardly therefrom when the movable frame 32 is in the retracted position illustrated in FIG. 3*a*. Alternatively, a tab that is similar in construction to tab 58, having an aperture at one end thereof, may be substituted for the cylindrical sleeve 54 that is coupled to the free end 52 of each of the pivot support members 50. A bushing can therefore be provided between the tab replacing the cylindrical sleeve 54 and the tab 58 that is affixed to the movable frame to provide for the rotation of the tab 58 about a shoulder bolt which has been inserted in the tab-bushing-tab configuration.

Figure 5:
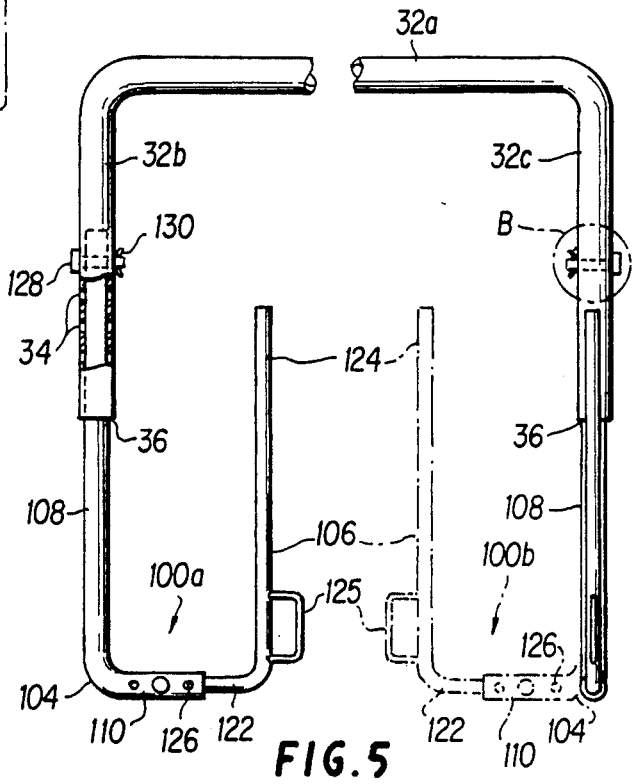
FIG. 5 is a front elevational view of the movable frame member of the spa cover support device of FIG. 1 illustrating cover retention members in an extended and retracted position.

With reference to FIG. 5, the generally U-shaped movable frame 32 comprises an intermediate portion 32*a* from which two legs 32*b* and 32*c* depend. The legs 32*b* and 32*c* are each provided with a series of equidistantly spaced apertures 34 that extend transversely across the diameter of the legs 32*b* and 32*c*. The apertures 34 are illustrated in the broken away portion of FIG. 5 so as to show a cross-section of the movable frame 32. The apertures 34 in the movable frame 32 provide the spa cover support device 30 with adjustability that permits the device to accommodate a variety of spas of different heights. Further details of the structure of the apertures 34 are described below in connection with the support members 100*a* and 100*b* that are detachably secured to the legs 32*b* and 32*c* of the movable frame 32, as shown in FIG. 5.

With reference to FIGS. 1 and 2, the spa cover support device 30 of the present invention further comprises a pair of laterally spaced struts 70 which are operable to pivot the movable frame 32 with respect to the fixed frame 42 between extended and retracted positions. Each of the struts 70 is mounted at a first end thereof 72 to the legs 42*b* and 42*c* of the fixed frame 42 and at a second end 74 thereof to corresponding legs 32*b* and 32*c* of the movable frame 32. The first and the second ends 72 and 74 of each strut 70 are detachably engageable with a corresponding ball swivel 76 to render the struts pivotably attachable to the fixed frame 42 and the movable frame 32. The ball swivels 76 are described in further detail below in connection with the description of lower and upper strut mounts 80 and 84.

Each leg 42*b* and 42*c* of the fixed frame 42 is provided with a lower strut mount 80 (FIGS. 2 and 4) to engage the first end 72 of a corresponding one of the struts 70. Each lower strut mount 80 is formed from a substantially flat member which is secured at one edge thereof to the fixed frame 42 and which extends outwardly therefrom. Each lower strut mount 80 further comprises a threaded aperture 82 that is dimensioned to receive a ball swivel 76 therein for engagement with the first end 72 of an associated strut 70 whereby the first end 72 of each strut 70 is provided with a receptable for receiving the ball swivel 76. The ball swivel 76 and lower strut mount 80 assembly for each of the struts 70 permits for the rotation of the first end 72 of the corresponding strut about the ball swivel 76.

With reference to FIG. 1, each of the legs 32*b* and 32*c* of the movable frame 32 is provided with an upper strut mount 84 to engage the second end 74 of a corresponding one of the struts 70. As shown in FIG. 2, the upper strut mount 84 is formed from a substantially flat plate member which is secured along one edge thereof to the movable frame 32 and which extends outwardly therefrom. A plurality of threaded mount apertures 86 are formed in the strut mount 84 that are of sufficient size to receive a ball swivel 76 therein for engagement with the second end 74 of a corresponding one of the struts 70 whereby the second end 74 of each strut is provided with a receptacle for receiving the ball swivel 76. The ball swivel 76 is insertable into a selected one of the apertures 86 of a corresponding upper strut mount 84 to vary the magnitude and point at which the strut 70 exerts a force along the movable frame 32. Selection of an appropriate one of the plurality of plate apertures allows for accommodation of a wide variety of spa covers of differing size and weight.

The struts 70 are preferably of the gas-assisted variety, although other types of struts, such as spring-assisted struts, can be substituted therefor for use in the subject invention. The struts 70 are arranged within the device 30 so as to be compressed when the movable frame 32 is in the retracted position shown in FIG. 3*a*. When the frame 32 is in the retracted position, the struts 70, by virtue of their mounting to the strut mounts 84, are arranged in an overcentered configuration, regardless of which mount aperture 86 is selected, so as to maintain the struts in a state of compression. The retention force exerted against the compressed struts when the movable frame 32 is in the retracted (overcentered) position can be overcome by displacing the movable frame 32 a nominal distance away from the fixed frame 42, at which point the compression force stored within the struts is released, thereby pivoting the movable frame 32 into the extended position shown in FIG. 2.

The lower strut mounts 80 and the upper strut mounts 84 are designed and positioned, respectively, along a portion of corresponding legs 42*b*, 42*c* and 32*b*, 32*c* of the fixed frame 42 and the movable frame 32, respectively, to optimally position the struts 70 within the support device 30. For example, the lower strut mounts 80 are positioned generally at the ends of the legs 42*b* and 42*c* that are closest to the base 18 of the spa 10, as shown in FIG. 1, to minimize the force that is exerted by the struts 70 against the fixed frame 42 when the struts 70 are released from compression. The upper strut mounts 84 are positioned along the legs 32*b* and 32*c* of the movable frame 32 at a predetermined position that is closely adjacent to the intermediate portion 32*a* of the movable frame 32. Positioning of the struts 70 along the legs 32*b* and 32*c* a sufficient distance from the intermediate portion 32*a* of the movable frame 32 enables the struts 70 to exert a torque force against the movable frame 32 that is operable to pivot the movable frame 32 along an arcuate path from a retracted position to an extended position. The torque force exerted by the struts is of sufficient magnitude to extend the movable frame 32 and the additional weight of the spa cover 20 after the spa cover has been removed from the spa 10 and placed onto the receiving surface 31 provided by the legs 32*b* and 32*c* of the extended movable frame 32. Structural reinforcement of the side 14 of the spa 10 can, therefore, be minimized, as the aforedescribed positioning of the lower strut mounts 80 and the upper strut mounts 84 together permit suitable positioning of the struts 70 to provide support for the weight of the cover 20 and the spa cover support device 30 with minimal force exerted against the side 14 of the spa 10.

The overcenter configuration of the struts 70 creates a torque force about the struts 70 which retains the movable member 32 in a retracted position by urging the second end 74 of each strut toward the side 14 of the spa 10. With reference to FIG. 3*a*, the struts 70 are each angled away from a reference line "A" that extends between the first end of the strut 72 and the shoulder bolt 56 at the pivot tab 58, and therefore away from the movable frame, regardless of which aperture 86 the second end 74 of the strut is inserted. The orientation of the strut 70 with respect to the reference line "A" is more clearly shown in FIG. 3*b*. With reference to FIG. 3*b*, broken lines 71 which intersect each of the respective apertures 86 of the upper strut mount 84 are shown in place of the strut 70. The broken lines illustrate the positioning of the strut away from reference line "A" and from the movable frame 32 when the movable frame is placed in a retracted position. The retentive force acting on the struts 70 as the result of the overcenter configuration can be easily overcome when the spa user exerts a nominal force against the movable frame to pivot the movable frame 32 away from the fixed frame 42 toward an extended position, as depicted in FIG. 2. Placement of the upper strut mounts 84 adjacent the intermediate portion 32*a* of the movable frame permits the second ends 74 of the struts 70 to exert a force against the movable frame 32 that is sufficient to pivot the movable frame 32 to the extended position shown in FIG. 2. The struts 70 are configured to increase in length so as to exert sufficient force to displace the movable frame 32 away from the fixed frame 42 when each of the struts 70 have been displaced with respect to the side wall 14 of the spa 10 from an angle "α" to a nominal distance past a position corresponding to line "A" in FIG. 3*a*. The relatively small displacement of the struts 70 that is required to release the struts from compression therefore reduces the effort that is required to be exerted by the spa user in initiating displacement of the spa cover support device 30 toward the extended position, regardless of whether or not a cover has been placed on the movable frame 32.

After the spa cover support device 30 of the present invention is displaced to the extended position and the cover is advanced onto the receiving surface 31, the cover can subsequently be displaced toward the retracted position so as to stow the cover vertically with respect to the side 14 of the spa 10. The movable frame 32 is preferably provided with means for retaining the cover 20 thereon throughout displacement of the movable frame 32. In the illustrated embodiment, the retaining means comprises support members 100*a* and 100*b* that are attachable, respectively, to corresponding free ends 36 of the legs 32*b* and 32*c* of the movable frame 32, as shown in FIG. 5. Each of the support members 100*a* and 100*b* can comprise a unitary member that is formed into a generally U-shaped member. Alternatively, the support members 100*a* and 100*b* can comprise first and second interlocking members 104 and 106 that are selectively engageable with one another, as shown in FIG. 5.

With respect to the arrangement of mutually engageable interlocking members depicted in FIG. 5, each of the first interlocking members 104 is configured as a unitary tubular member having an outer diameter that is smaller than the inside diameter of the tubular movable frame 32. Thus, each first interlocking member 104 is dimensioned to be insertable within a corresponding one of the legs 32*b* and 32*c* of the movable frame 32 to be securedly mounted therein in the manner described below. Each of the first interlocking members 104 is provided with a generally L-shaped configuration having an elongated leg 108 and a short leg 110, with the elongated leg 108 being engageable with the movable frame 32, as by insertion into the movable frame 32 in the manner depicted in FIG. 5 by the phantom lines on leg 32*b*.

Figure 7:
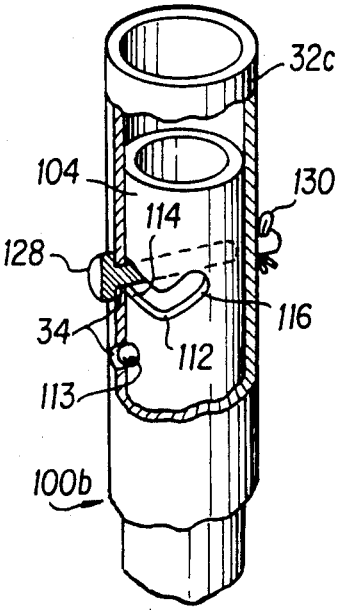
FIG. 7 is an enlarged, partially cut away front perspective view of the circled portion of the movable frame member depicted in FIG. 5.

With reference to FIG. 7, which represents an enlarged view of designated portion "B" of the movable frame 32 shown in FIG. 5, shows the leg portion 32*c* of the movable frame 32 as having an end of the elongated leg 108 of a corresponding first interlocking member 104 inserted therein. Referring collectively to FIGS. 6 and 7, the elongated leg 108 of the first interlocking member 104 of each support member is provided with a generally V-shaped, curvalinear slot 112 indicated by the phantom lines in FIG. 6. The curvalinear slot 112 is useful in retaining the elongated leg 108 of the first interlocking member 104 within the movable frame 32 and can be aligned with one of the apertures 34 of the movable frame 32 to permit insertion therethrough of a pin such as a clevis pin that can extend across the inner diameters of the movable member and the support member, as shown in FIGS. 5 and 7. The clevis pin 128 can be provided with retaining means 130, i.e., a spring clip, at one end thereof for retaining the pin 128 within the aligned apertures 34 of the concentrically disposed movable frame 32 and U-shaped support member 100. The short leg 110 of each first interlocking member 104 is provided with a plurality of apertures 126, as shown in FIG. 5, which are provided for use in retaining a second interlocking member 106 within the corresponding first interlocking member 104 in the manner described below.

Each of the second interlocking members 106 comprises a unitary tubular member composed of rigid material that is configured and dimensioned to cooperate with the first interlocking member 104. In the illustrated embodiment of FIGS. 5 and 6, the second interlocking members 106 are each provided with an external diameter that is less than the internal diameter of each of the first interlocking members 104 such that one end of each of the second interlocking members 106 is slidably received within a corresponding one of the first interlocking members 104. Each of the second interlocking members 106 is provided with an L-shaped configuration having a first leg 122 and a second leg 124, wherein the first leg 122 is insertable within a corresponding one of the first interlocking members 104 and the second leg 124 provides a retaining surface for maintaining the spa cover 20 within the cover supports 100.

Figure 8:
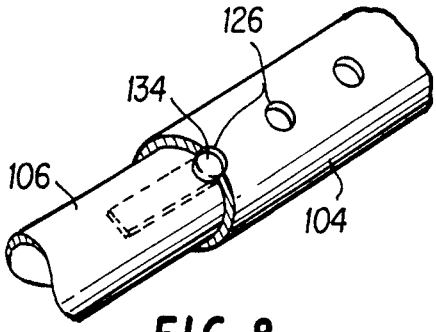
FIG. 8 is a perspective view of a locking arrangement for interlocking tubular members from which the cover retention members depicted in FIG. 5 are comprised.

With reference to FIG. 8, means is depicted for adjusting the width of each cover support member 100 for accommodating spa covers of a variety of different thicknesses. In the illustrated arrangement, the first leg 122 of each of the second interlocking members 106 is provided with a resilient spring button 134 that is of sufficient size to be received within a corresponding one of the apertures 126 of a first interlocking member 104. The spa user can adjust the width of the support member 100 by depressing the spring button 134 on each of the second interlocking members 106 and inserting the second interlocking member 106 into the short leg 110 of a corresponding one of the first interlocking members 104, to a user-selected aperture 126, thereby creating a U-shaped support member 100. The resilience of the spring button 134 forces the spring button 134 to return from a depressed position and protrude through the selected one of the plurality of apertures 126 formed in the short leg 110 of the first interlocking member 104 so as to secure the first interlocking member 104 and the corresponding second interlocking member 106 together. Alternatively, each of the second interlocking members 106 can be detachably secured within a corresponding one of the first interlocking members 104 by such conventional means as a clevis pin or a bolt and nut arrangement. Further, the first leg 122 of each of the second interlocking members 106 can be alternatively dimensioned such that the short leg 110 of a corresponding one of the first interlocking members 104 can be received therein. The first leg 122 of each of the second interlocking members 106 and the short leg 110 of each of the first interlocking members 104 can alternatively be provided with a plurality of apertures and a resilient spring button, respectively, for adjustably securing together respective first interlocking members 104 and second interlocking members 106.

With further reference to FIG. 5, the spa cover support members 100 are illustrated as being pivotably displaceable with respect to the movable frame 32. In the illustrated configuration, the spa cover support member 100*a* that is coupled to movable frame leg 32*b* is disposed so as to be generally coplanar with respect to the movable frame 32, whereas the support member 100*b* that is coupled to movable frame leg 32*c* is disposed generally transversely with respect to the plane of the movable frame 32. The tubular configuration of the support members 100*a* and 100*b* and the movable frame 32, in combination with the curvalinear aperture 112, allows for the support members 100*a* and 100*b* to be rotatable within a corresponding one of the legs of the movable frame 32. With reference to FIG. 7, the pin 128 is generally fixed in position with respect to the leg of the movable frame and provides a surface along which the curvalinear aperture 112 is guided, such that the V-shaped, curvalinear aperture 112 and the pin 128 assembly limits the rotation of each support member 100 within a corresponding one of the legs 32*b* and 32*c* of the movable frame 32 to an arcuate path of approximately 90°.

Referring once again to FIG. 7, there is illustrated in detail the mutually cooperative arrangement of movable frame leg 32*c*, spa cover support member 100*b*, and curvalinear slot 112 that provides for rotatable adjustability of each spa cover support member with respect to the movable frame 32. As is shown in the drawing, the pin 128 is disposed on one side 114 of the curvalinear aperture 112 when the support member 100*b* is arranged to be generally perpendicular to the plane of the movable frame 32. When the support member 100*b* is rotated to a position that is generally coplanar with respect to the plane of the movable frame 32, as indicated by the phantom lines in FIG. 5, the curvalinear aperture 112 of the support member 100*b* is advanced along the pin 128 so that the pin is positioned adjacent to the slot side 116 which is opposite the slot side 114. Conversely, for the spa cover support member 100*a* attached to leg 32*b* of the movable frame 32 to rotate from the coplanar position shown in FIG. 5 to a perpendicular position with respect to the movable frame 32, the support member slot 112 is advanced along the pin 128 from one side 114 of the slot 112 to the opposite side 116 thereof. The curvalinear shape of the support member apertures 112 is particularly advantageous, for the shape provides a positive detent whereby the support member can be guided to either a generally coplanar or perpendicular position with respect to the plane of the movable frame 32 to provide for both compact storage of the spa cover support members and maximum spa cover storage capacity.

Rotatable adjustability of the support members 100 relative to the movable frame 32 in the manner described above is advantageous for, when the spa 10 is not in use, the movable frame 32 can be positioned in a retracted position and the support members 100*a* and 100*b* can be rotated to a generally coplanar position with respect to the movable frame 32, thereby allowing for the spa cover device 30 to be compactly positioned adjacent the side 14 of the spa 10. When the spa cover device 30 is to be positioned to receive therein a spa cover, the support members 100*a* and 100*b* can be rotated to a position that is generally perpendicular with respect to the plane of the movable member 32 so as to define a space for receiving a spa cover 20 therein. Each of the second interlocking members 124 is provided with a handle 125 to provide means for grasping the spa cover device when the cover is received therein in order to facilitate positioning of the movable frame from a retracted position to an extended position.

With further reference to FIG. 7, there is depicted an arrangement for detachably securing each of the cover support members in a position that is generally perpendicular to the plane of the movable frame that utilizes a selected one of the apertures in the movable frame. In this arrangement, the elongated leg 108 of the first interlocking member 104 is provided with a resilient spring button 113 which is generally disposed a distance from the curvalinear slot 112 that is substantially equal to the distance between respective apertures 34 in the leg portion 32*c* of the movable frame 32. Thus, when the curvalinear slot 112 (FIG. 6) of the support member is aligned with a movable frame aperture 34 so as to receive a pin 128, the spring button 113 is therefore aligned with a adjacent movable frame aperture 34 and protrudes therethrough to secure the support member within the movable frame when the support member is perpendicular to the plane of the movable frame.

Figure 9:
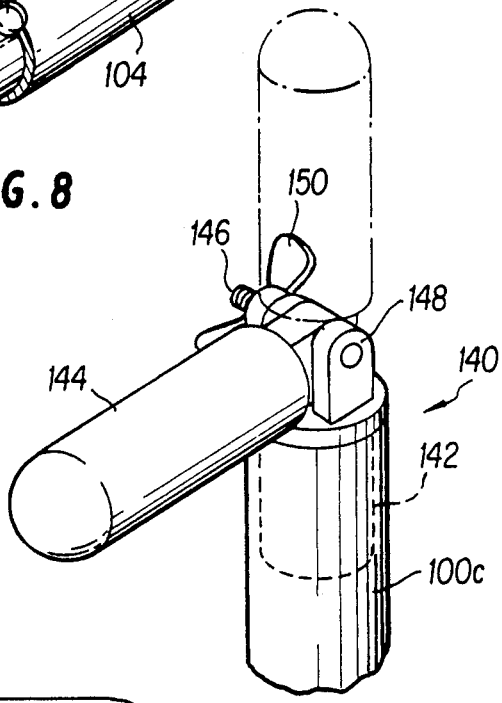
FIG. 9 is a perspective view of an extension member for use with an alternative embodiment of the present invention.
Figure 10:
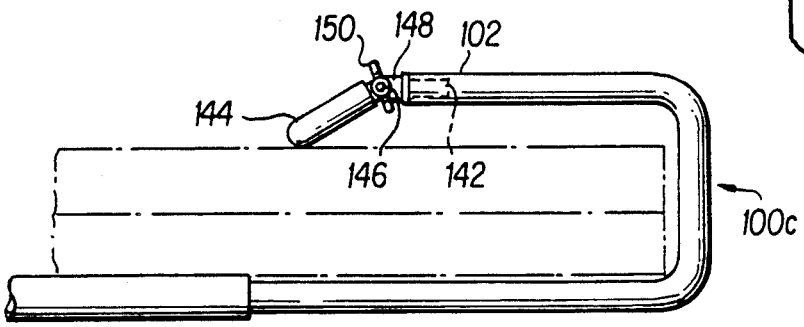
FIG. 10 is a side view of the extension member depicted in FIG. 9, shown attached to a portion of a spa cover support device constructed in accordance with an alternative embodiment of the present invention.

In a preferred embodiment of the spa cover device, as shown in FIG. 2, the first interlocking member 104 and the second interlocking member 106 of the illustrated support member 100 are adjustable at the junction 136 thereof in the manner described in detail above such that a spa cover 20 can be retained against the receiving surface 31 of the movable frame 32. Alternatively, the support member 100 can be configured as a unitary, generally U-shaped rigid member which is not adjustable so as to receive spa covers having various thicknesses, in which case the support member 100*c* can optimally be provided with an extension member 140 to stabilize the cover 20 with respect to the movable frame 32, as shown in FIG. 9. The extension member 140 comprises an end portion 142 that is insertable within the free end 102 of tubular support member 100*c*, as shown in FIG. 10, and includes a pivotable portion 144 which is rotatable about a shaft 146 that extends through aligned apertures formed in the extension member and a yoke 148. The extension member 142 is securable in a fixed, user-selected position with respect to the yoke 148 by a wing nut 150 such that the pivotable portion 144 can be secured in one of a plurality of positions with respect to the end portion 142, as indicated in phantom in FIGS. 9 and 10. Thus, the extension member 140 can be disposed at the end of a support member 100*c* and pivoted toward a spa cover 20 on the receiving surface 31 of the movable frame 32 so as to retain the spa cover against the receiving surface 31 of the movable frame 32, as shown in FIG. 10.

Figure 11:
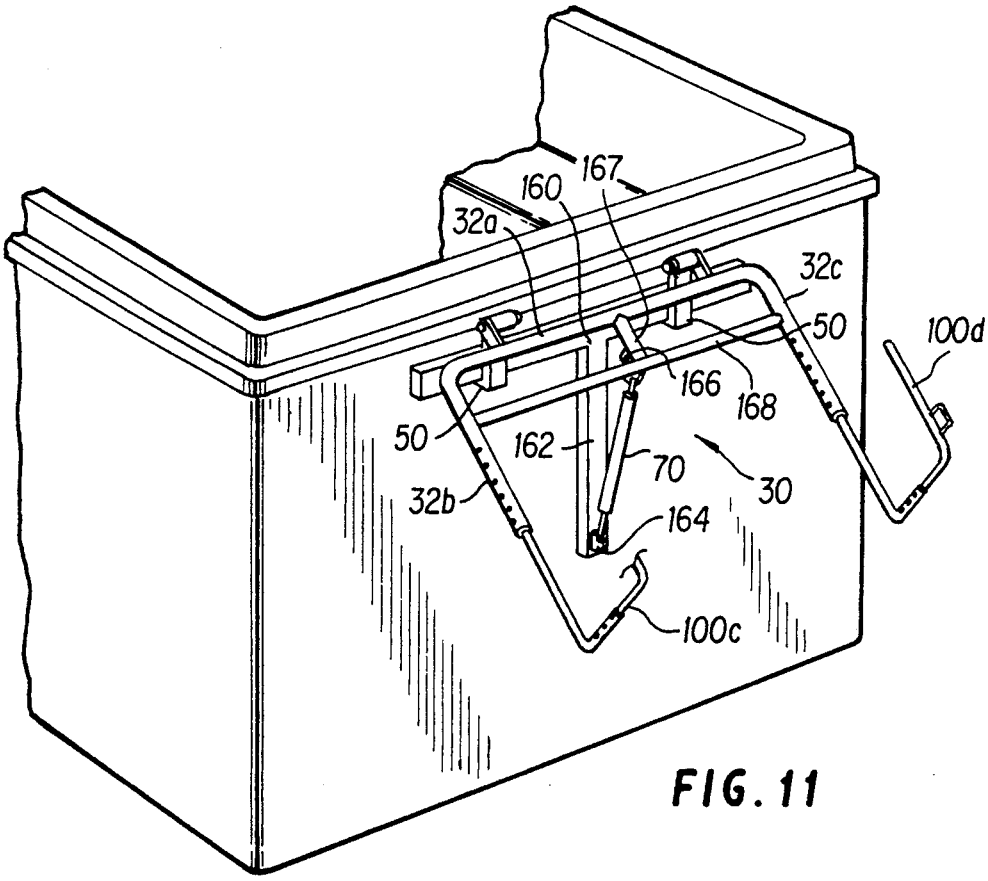
FIG. 11 is a perspective view of a spa cover support device constructed in accordance with an alternative embodiment of the present invention, shown mounted to the side of a spa.
Figure 12:
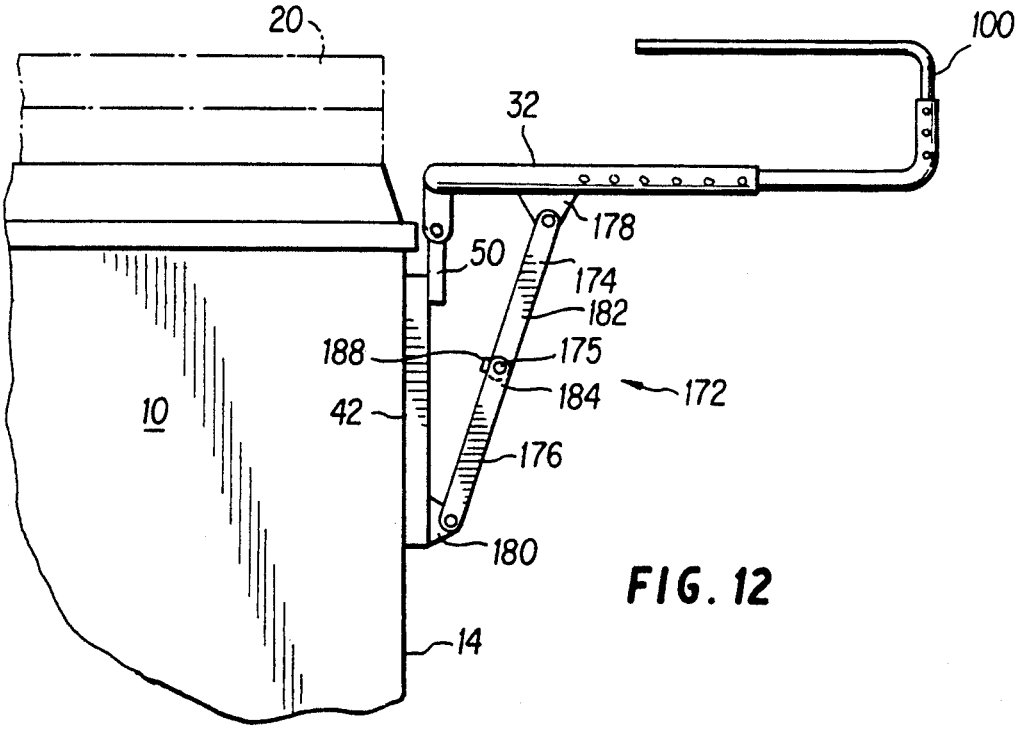
FIG. 12 is a side view of a spa cover support device constructed in accordance with an alternative embodiment of the present invention.
Figure 13:
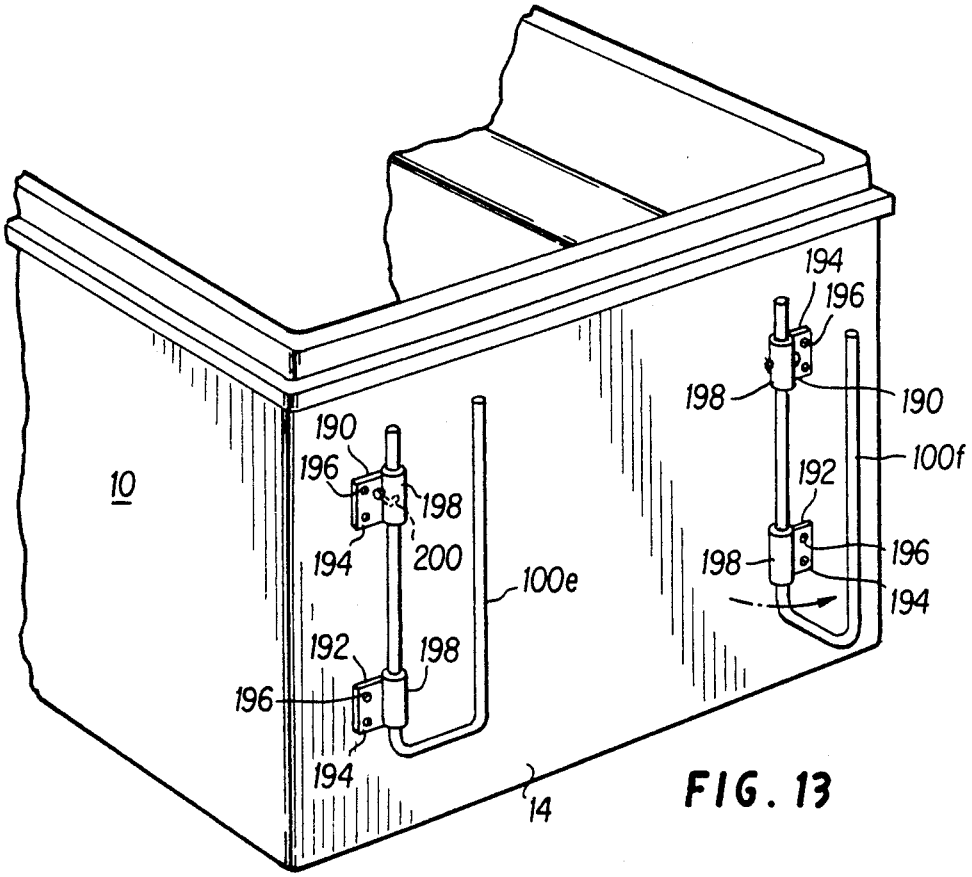
FIG. 13 is a perspective view of a spa cover support device constructed in accordance with an alternative embodiment of the present invention, shown mounted to the side of a spa.

Alternative embodiments of the present invention are depicted in FIGS. 11 through 13. In the arrangement depicted in FIG. 11, the fixed frame, designated by reference number 160 is provided with a generally T-shaped configuration and includes a strut 70 that is pivotably attachable at one end thereof to a vertical portion 162 of the frame 160, by a lower strut mount 164. The strut 70 is pivotably attachable at an opposite end thereof to a cross bar 168 that is secured between the legs 32*b* and 32*c* of the movable frame 32. As shown in FIG. 11, a second strut mount 166 is mounted between the cross bar 168 and the leg 32*a* of the movable frame by means of an additional member 167 for receiving the opposite end of the strut 70. The strut mounts 164 and 166 are substantially similar in construction to the lower strut mount 80 and upper strut mount 84, respectively, described above in connection with FIG. 4.

Figure 15A:
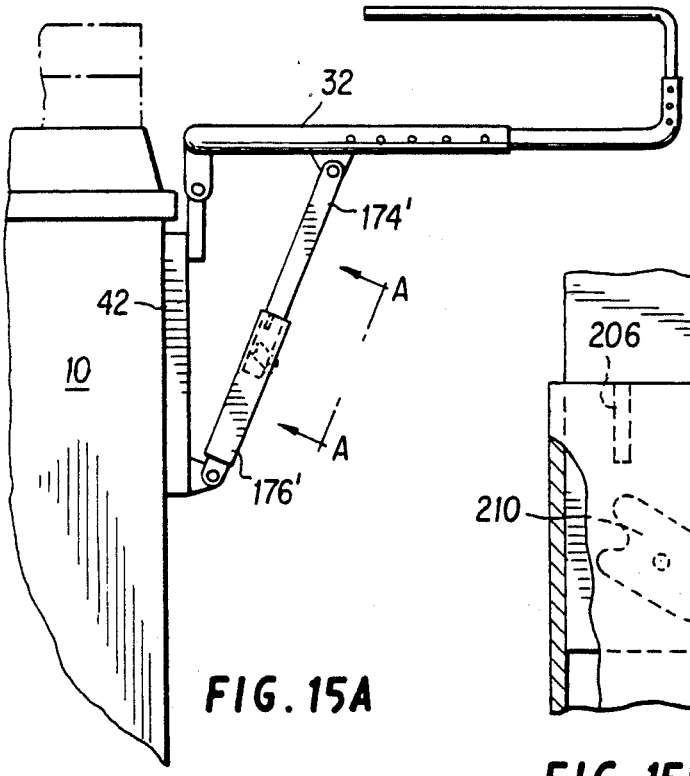
FIG. 15*a* is a side view of a strut member constructed in accordance with an alternative embodiment of the present invention.
Figure 15B:
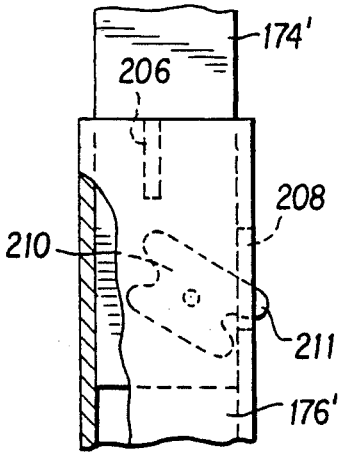
FIG. 15*b* is a partial, enlarged view of the strut member depicted in FIG. 15*a*.
Figure 15C:
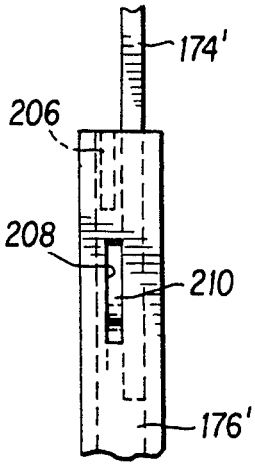
FIG. 15*c* is a view of the strut of FIG. 15*a* taken along line A—A.

With reference to FIG. 12, a non-resilient strut 172 can be substituted for the resilient gas-assisted or spring assisted strut 70 previously described in connection with FIGS. 1, 2 and 3*a*, as well as for the strut 70 of alternative embodiment of the spa cover support device 30 shown in FIG. 11. The non-resilient strut 172 comprises first and second interengageable arms 174 and 176 which are pivotably coupled to one another along respective ends 182 and 184 to form a hinge joint 175. The free end of the arm 174 is coupled to an upper strut mount 178 that is affixed to a lower surface of the movable frame 32. The free end of the second arm 176 is coupled to the lower strut mount 180, which is affixed to the fixed frame 42. The hinged ends 182 and 184 of the arms 174 and 176 are rotatable about the hinge joint 175 to bring the end of the first interengageable arm 174 that is pivotably attached to the movable frame 32 toward the end of the second interengageable arm 176 that is pivotably attached to the fixed frame 42, thereby pivoting the movable frame 32 from the depicted extended position toward a retracted position that is generally parallel with respect to the side 14 of the spa 10. The first interengageable arm 174 is provided with a tab member 188 to prevent the undesirable rotation of the second interengageable arm 176 away from the side of the spa 10. The first and second interengageable arms 174 and 176 are permitted to rotate about the hinge 175 from a folded position, corresponding to when the movable frame is retracted, to a position wherein the first and second interengageable arms 174 and 176 are generally colinear so as to form a generally rigid strut 172 as shown in FIG. 12. Alternatively, the arm 174 can be arranged so as to be telescopically receivable within the end 184 of the second interengageable arm 176. With reference to FIGS. 15*a*, 15*b*, and 15*c* the first arm 174' can be provided with means for detachable engagement with the second interengageable arm 176' such that the first arm is selectively displacable within the second arm. For example, the first arm 174' can be provided with a tab 210 which is rotatably attached thereto and which comprises leg portions 211 as shown in FIG. 15*b*. The leg portions 211 are each configured to engage a slot 208 provided in the second arm 176' to removably secure the first arm 174' within the second arm 176'. The tab 210 is disengaged from the slot 208 by retracting the first arm 174' from within the second arm 176' such that the tab 210 contacts a bar member 206 secured to the second arm and pivots its corresponding leg portion 211 away from the slot 208. The telescopic first and second interengageable arms 174' and 176' can therefore be longitudinally extended and retracted so as to permit the movable frame to be pivotably displaced between the extended and retracted positions depicted in FIGS. 2 and 3*a*, respectively.

Figure 14:
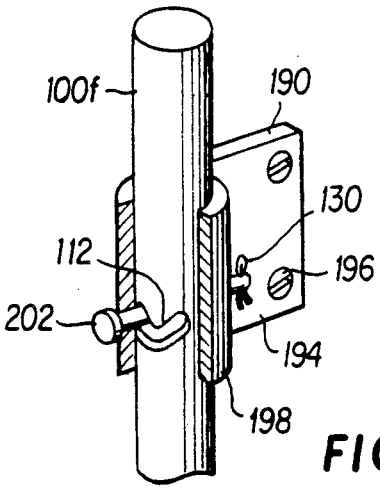
FIG. 14 is a front elevational view of a portion of the spa cover support device depicted in FIG. 13 having a portion thereof cut away.

In accordance with another embodiment of the present invention, as depicted in FIG. 13, the generally U-shaped support members 100*e* and 100*f* that were previously described in connection with FIGS. 5 and 6 can themselves be arranged so as to be vertically attachable to the side 14 of the spa 10. Support member attachment to the spa is accomplished through an arrangement of upper and lower brackets 190 and 192, respectively, each of which comprises a flat section 194 for mounting each of the brackets 190 and 192 to the side 14 of the spa 10 with conventional features such as threaded screws 196 and a tubular section 198 through which a corresponding one of the tubular support members 100*e* and 100*f* can be inserted. Each of upper brackets 190 comprises an aperture 200 formed in the tubular section 198 thereof that is alignable with the curvalinear aperture 112 of a corresponding one of the support members 100*e* or 100*f* extending through the bracket tubular section. A pin 202 (FIG. 14) can be inserted through the aligned apertures of each of the support members 100*e* and 100*f* and a corresponding upper bracket 190 so as to retain the support members 100*e* and 100*f* within the tubular section 198 of the bracket. As discussed in connection with FIG. 7, the curvalinear aperture 112 of each of the support members 100*e* and 100*f* illustrated in FIG. 14 are useful in that the support members 100*e* and 100*f* may be rotated so as to be flush against the side 14 of the spa 10, in a compact configuration when the cover 20 is on the spa 10 as illustrated by support member 100*e* in FIG. 13. Further, the support members 100*e* and 100*f* can be rotated to a position that is perpendicular with respect to the side 14 of the spa 10 for receiving a spa cover 20 therein as illustrated by support member 100*f* in FIG. 13.

Although the present invention has been described with reference to a preferred embodiment and a plurality of alternative embodiments, the invention is not limited to the details thereof. Other substitutions and modifications will occur to those of ordinary skill in the art, and all such substitutions and modifications are intended to fall within the spirit and scope of the invention as defined in the appended claims.

What is claimed is:

1. Apparatus for receiving the cover for a spa having a top and side walls, the apparatus comprising:

at least one movable member having first and second end portions, said movable member adapted to slidably receive said spa cover thereon and having means on said first end portion for receiving and retaining the spa cover thereon;

means at the second end portion of said movable member for pivotably securing said movable member to a side of the spa from an extended position substantially perpendicular to a side wall of the spa to a retracted position substantially parallel with the side wall of the spa;

means for displacing said movable member between said extended position and said retracted position with respect to the spa.

2. The apparatus of claim 1, wherein said displacing means comprises means for maintaining said movable member in a substantially coplanar position with respect to an upper surface of the spa so as to facilitate transfer of the cover from the spa to the cover receiving and retaining means.

3. The apparatus of claim 1, wherein said displacing means is operable to maintain said movable member in a generally parallel position with respect to the side of the spa.

4. The apparatus of claim 1, wherein said displacing means comprises at least one strut having a first end adapted to be pivotably secured to said spa side wall and a second end pivotably coupled to said movable member.

5. The apparatus of claim 4, wherein said strut is a gas-assisted strut.

6. The apparatus of claim 4, wherein said strut comprises first and second arms that are coupled to one another by a hinge member.

7. The apparatus of claim 4, wherein said strut comprises first and second arms, one of said first and second arms being telescopically received within the other of said first and second arms.

8. The apparatus of claim 4, further comprising lower and upper strut mounts, said lower strut mount adapted to be mounted to the side of the spa and pivotably engaged with said first end of said strut, and said upper strut mount being mounted to the movable member and pivotably engaged with said second end of said strut.

9. The apparatus of claim 8, wherein said upper strut mount comprises a plurality of apertures formed therein, said apertures being arranged so as to form a curvalinear path.

10. The apparatus of claim 8, wherein said upper and lower strut mounts are configured such that said strut attached thereto is angularly positioned with respect to said movable member so that said second end of said strut extends away from said movable member when said movable member is in a retracted position.

11. The apparatus of claim 1, wherein said movable member comprises a generally rigid, U-shaped frame member having first and second legs which extend from an intermediate portion disposed therebetween.

12. The apparatus of claim 11, wherein said pivotable securing means comprises at least one pivot member having a first end that is pivotably attachable to the intermediate portion of said movable member and a second end that is attachable to the spa.

13. The apparatus of claim 11, wherein said displacing means comprises a strut that is operable to support each of said first and second legs of said movable member between extended and retracted positions with respect to the spa.

14. The apparatus of claim 11, wherein said securing means comprises at least one bracket for pivotably securing one of said first and second legs of said movable member to the side of the spa.

15. The apparatus of claim 1, wherein said pivotable securing means comprises a frame member that is attachable to the side of the spa.

16. The apparatus of claim 15, wherein said frame member comprises a generally U-shaped member having an intermediate portion and first and second legs depending therefrom.

17. The apparatus of claim 15, wherein said frame member comprises a generally T-shaped member having first and second portions that are generally mutually perpendicular.

18. The apparatus of claim 1, wherein said pivotable securing means comprises at least one pivot member having a first end that is pivotably attachable to said movable member and a second end that is attachable to the side of the spa.

19. The apparatus of claim 18, wherein said pivot member is provided with a generally L-shaped configuration to define a recess for providing clearance between said movable member and the side of the spa.

20. The apparatus of claim 1, wherein said retaining means comprises a generally U-shaped support member that is detachably secured to said movable member.

21. The apparatus of claim 20, wherein said support member is adjustably attachable to said movable member.

22. The apparatus of claim 21, wherein said movable member defines a tubular lumen dimensioned to receive said support member.

23. The apparatus of claim 22, wherein said support member comprises at least one curvalinear slot.

24. The apparatus of claim 23, wherein said movable member comprises a plurality of apertures which extend through said tubular lumen, said support member being selectively positionable within said movable member and securable therein upon alignment of said slot of said support member with respect to a selected one of said apertures of said movable member.

25. The apparatus of claim 24, wherein said support member comprises resilient locking means biased so as to extend through a selected one of said apertures of said movable member to fix the position of said support member within said movable member.

26. The apparatus of claim 24, wherein said support member is rotatable within said movable member along a prescribed arcuate path, said arcuate path being defined by said curvalinear slot of said support member, wherein said slot of said support member is advanced along a pin inserted into a selected one of said plurality of apertures of said movable member when said selected aperture is in alignment with said slot.

27. The apparatus of claim 26, wherein said curvalinear slot is configured so as to render said arcuate path such that said support member is rotatable between a position that is generally coplanar with respect to the plane of said movable member and a position that is generally perpendicular with respect to the plane of the movable member.

28. The apparatus of claim 20, wherein said support member comprises first and second releasably interengageable members.

29. The apparatus of claim 28, wherein one of said first and second interengageable members is insertable within the other of said first and second interengageable members.

30. The apparatus of claim 28, wherein each of said first and second members is provided with a generally L-shaped configuration.

31. The apparatus of claim 28, wherein said first interengageable member comprises locking means and said second interengageable member comprises a plurality of apertures, said locking means being biased so as to extend through a selected one of said plurality of apertures of said second interengageable member.

32. The apparatus of claim 1, wherein said retaining means comprises a generally elongate member attachable at a first end thereof to said movable member and having a hinged portion at a second end thereof, said hinged portion being selectively positionable with respect to said movable member so as to extend toward a cover received within said retaining means.

* * * * *